United States Patent [19]

Kobayashi et al.

[11] Patent Number: 4,475,015

[45] Date of Patent: Oct. 2, 1984

[54] MULTIPOSITION SWITCH

[75] Inventors: Hirotsugi Kobayashi, Aichi; Shoichi Harada, Gifu, both of Japan

[73] Assignee: Kabushiki Kaisha Tokai Rika Denki Seisakusho, Aichi, Japan

[21] Appl. No.: 379,003

[22] Filed: May 17, 1982

[30] Foreign Application Priority Data

May 26, 1981 [JP] Japan ..... 56-75946[U]

[51] Int. Cl.³ ..... H01H 9/00; H01H 15/00

[52] U.S. Cl. ..... 200/5 R; 200/16 C; 200/17 R

[58] Field of Search ..... 200/4, 5 R, 5 B, 5 C, 200/5 D, 11 G, 11 J, 11 K, 16 C, 16 D, 17 R, 18, 61.27, 61.54, 61.85, 61.86, 61.88

[56] References Cited

U.S. PATENT DOCUMENTS

| | | | |
|---|---|---|---|
| 3,814,871 | 6/1974 | Osika | 200/17 R X |
| 3,939,313 | 2/1976 | Hayashi et al. | 200/11 J |
| 4,115,670 | 9/1978 | Chandler | 200/5 R |
| 4,361,739 | 11/1982 | Harata et al. | 200/61.27 X |

FOREIGN PATENT DOCUMENTS

| | | |
|---|---|---|
| 56-33730 | 4/1981 | Japan . |
| 56-11716 | 3/1982 | Japan . |

*Primary Examiner*—J. R. Scott

*Attorney, Agent, or Firm*—Birch, Stewart, Kolasch & Birch

[57] ABSTRACT

A multiposition switch for operatively selecting any of the multipositions which are aligned and spaced from each other in two different directions. The multiposition switch includes a structure wherein all stationary contacts to be switched by first and second switching contacts are insert-molded onto an insulator member simultaneously and are fixed thereonto exactly in a predetermined arrangement. A first contact holder is moved in a first direction when an operation knob is operated in the first direction. A second contact holder is moved in a second direction when the operation knob is operated in the second direction while the first contact holder is maintained in a neutral position.

4 Claims, 8 Drawing Figures

MULTIPOSITION SWITCH

BACKGROUND OF THE INVENTION

Field of the Invention

The present invention relates to a multiposition switch adapted to be operably positioned in any of the multipositions which are aligned and spaced with respect to each other in two different directions.

Some of multiposition switches of this type have been known and are used, for example, as a combination switch for operating both a dimmer and a direction indicator of a motorbicycle. One type of known multiposition switches has first and second groups of positions; the first group of positions are aligned and spaced from each other in a first direction and are selected when a first contact holder is moved by the operation of an operation knob. The second group of positions are aligned and spaced from each other in a second direction orthogonal to the first direction and are selected when the second contact holder is moved, at a neutral position of the first contact holder, in the second direction by the operation of the operation knob. The first and second contact holders are slidably inserted between a switch case and an insulator member and the insulator member supports many stationary contacts fixed thereon which are disposed in such a way that, when one position between the first and second positions is chosen, a particular connection relationship is formed between connections which are defined as combinations between stationary contacts supported by the insulator member and first and second switching contacts supported respectively by said first and second contact holders. Such a conventional multiposition switch has some disadvantages in that it is difficult to fix each of the many stationary contacts exactly at a predetermined position on said insulator member and therefore the cost needed for manufacturing the switch is tend to increase.

One object of the present invention is to provide a multiposition switch having a structure which is adapted to be manufactured without any difficulty by mounting and fixing stationary contacts onto an insulator member for supporting the stationary contacts.

Another object of the present invention is to provide a multiposition switch including a plurality of stationary contacts being insert-molded together with the insulator member in a predetermined arrangement.

A further object of the present invention is to provide a method or a structure which is capable of fixing the plurality of stationary contacts simultaneously and exactly onto predetermined positions of the insulator member.

BRIEF DESCRIPTION OF THE DRAWINGS

Further objects and features of the present invention will appear as the description proceeds in connection with the appended claims and the annexed drawings wherein:

DETAILED DESCRIPTION OF THE INVENTION

Figure 4:
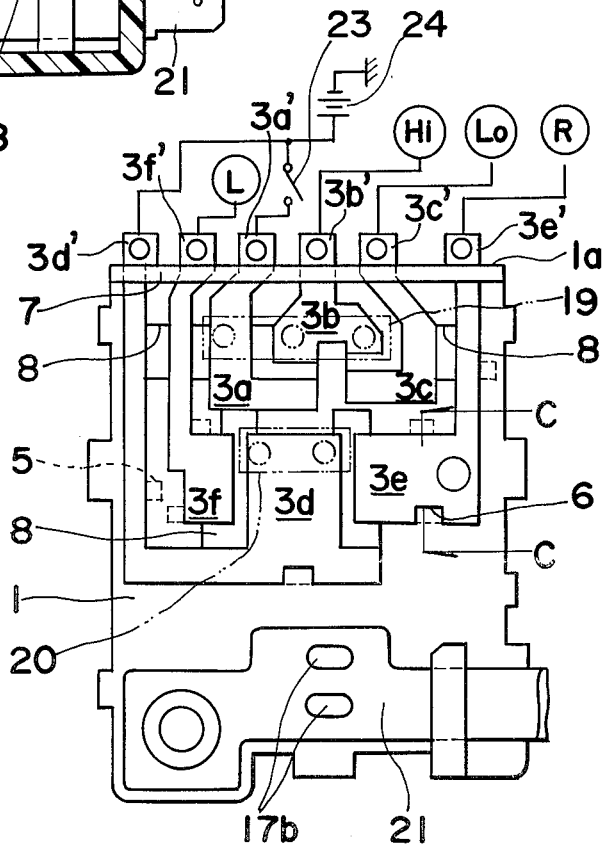
FIG. 4 is a front view of an insulator member of said multiposition switch supporting a first and second stationary contacts fixed thereon.

As illustrated in FIG. 4, an insulator member 1, such as a synthetic resin, is molded to a rectangular plate and a plurality of stationary electrical contacts 3*a*–3*f* are insert-molded onto the insulator member 1 during a process of molding according to a method of the present invention.

Figure 5:
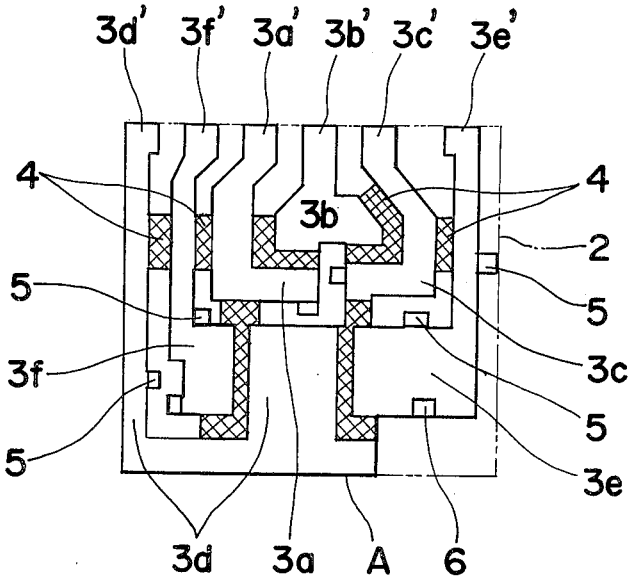
FIG. 5 is a plan view of a stencil-like member being prepared prior to insert-molding thereof which shows a plurality of connecting portions as double-hatched portions.
Figure 7:
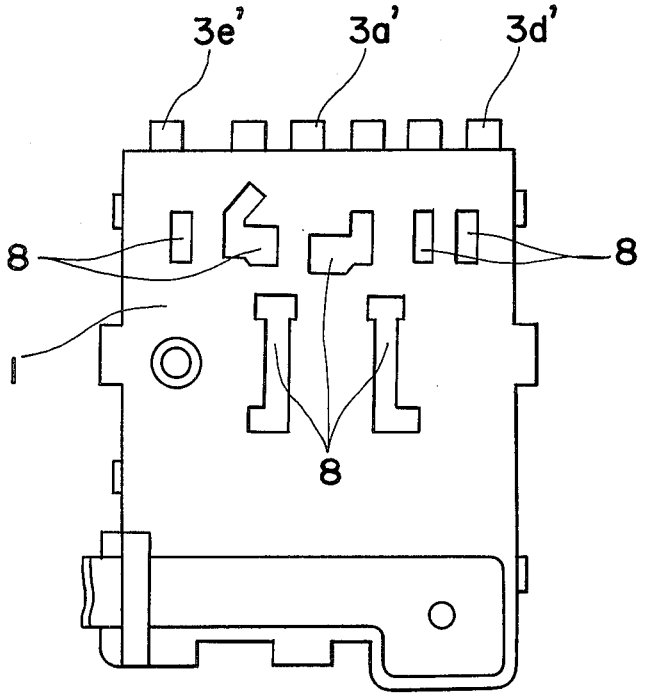
FIG. 7 is a rear view of said insulator members.

The plurality of stationary electrical contacts 3*a*–3*f* are initially formed as a stencil-like member A prior to the insert-molding thereof. As shown in FIG. 5, the stencil-like member A is a member having been punched from a rectangular sheet of electrically conductive material using a suitable punching apparatus. The stencil-like member A is comprised substantially of the plurality of stationary contacts 3*a*–3*f* and a plurality of connecting portions 4, . . . , 4 which provides a connection between adjacent stationary contacts to support each other on a flat plane defined thereby in a predetermined arrangement. This stencil-like member A is insert-molded, according to a method of insert-molding, together with the insulator member 1 to fix said plurality of stationary contacts 3*a*–3*f* simultaneously onto the insulator member 1 while maintaining said predetermined arrangement. Thereafter, the stencil-like member A is insert-molding and all of connecting portions 4, . . . , 4 are punched off to obtain the plurality of stationary contacts 3*a*–3*f* being isolated from each other electrically and fixed in said predetermined arrangement. For the purpose of punching off the connecting portions 4, . . . , 4, there is provided a plurality of apertures 8, . . . , 8 as shown clearly in FIG. 7, which are respectively positioned and configurated to correspond to said connecting positions 4, . . . , 4.

Figure 6:
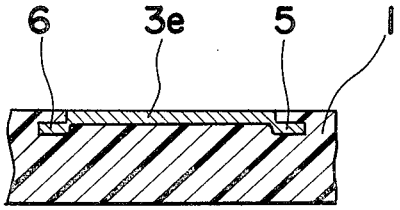
FIG. 6 is an enlarged sectional view of a portion of said insulator member being sectioned along a line C—C shown in FIG. 2.

As shown in FIG. 5 and FIG. 6, each stationary contact has at least one portion adapted to be insert-molded or buried into the insulator member 1 for fixedly maintaining each stationary contact even when an external force is exerted thereon during the operation of the multiposition switch. The portion may be a small projection 5 projecting from a point along an edge of the stationary contact or a concave portion 6 stamped out downwardly at a portion of an edge thereof. The small projections 5 and concave portions 6 are formed simultaneously during the punching of said stencil-like member A in such a manner that they are buried into said insulator member 1 after the insert-molding of said stencil like member A onto said insulator member 1, as shown clearly in FIG. 6.

As shown in FIG. 4, each of the stationary contacts 3*a*–3*f* has a contact portion adapted to be switched by the first or second switching contact 19 or 20 (shown by an imaginary dotted line) and a terminal portion 3*a*′, 3*b*′, . . . , or 3*f'* for connecting each stationary contact to an external line. Said terminal portions 3*a'*, . . . , 3*f'* are formed and aligned to project equally from an edge 1*a* of the insulator member 1 and spaced apart from each other. Each neck portion of the stationary contacts, from which the terminal portion projects, has been buried into and along said edge 1*a* of the insulator member 1 by a bar member 7 molded integrally along said edge for fixing each of stationary contacts together with the small projections 5 and concave portions 6.

The stationary contacts 3*a*–3*f* are grouped into first and second groups. The first group is composed of stationary contacts 3*a*, 3*b* and 3*c* which are adapted to be switched by first switching contact 19. On the other hand, said second group is composed of stationary contacts 3*d*, 3*e* and 3*f* which are adapted to be switched by second switching contact 20.

Figure 2:
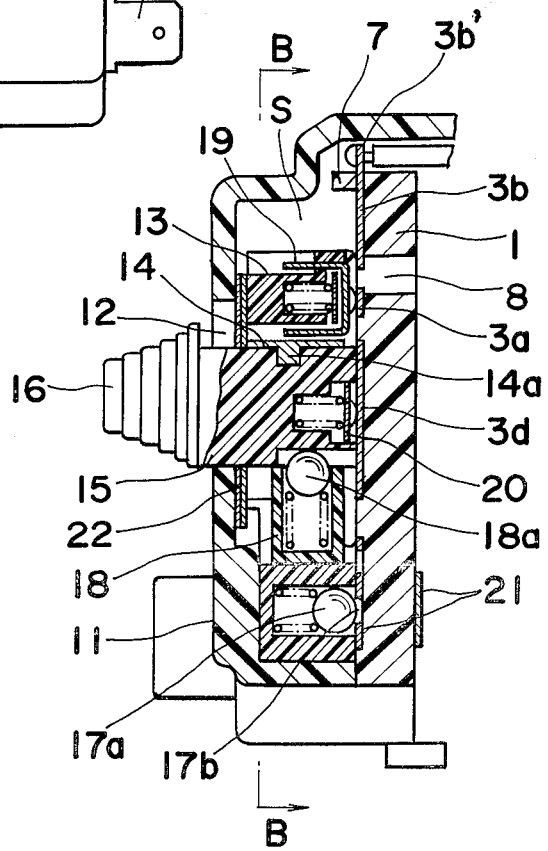
FIG. 2 is a sectional view of said multiposition switch along a line A—A of FIG. 1.

As shown in FIG. 2, the insulator member 1 is positioned into a switch case 11 of an insulator material from the rear side thereof and fixed to define a space S surrounded by a inner surface of the switch case 11 and the insulator member 1. Thereafter, first and second contact holders 13, 15 of an insulator material are slidably inserted for supporting first and second switching contacts 19, 20. The elements are spring-biased to maintain contact between the first and second switching contacts 19, 20 and the stationary contacts 3*a*–3*f*.

Figure 3:
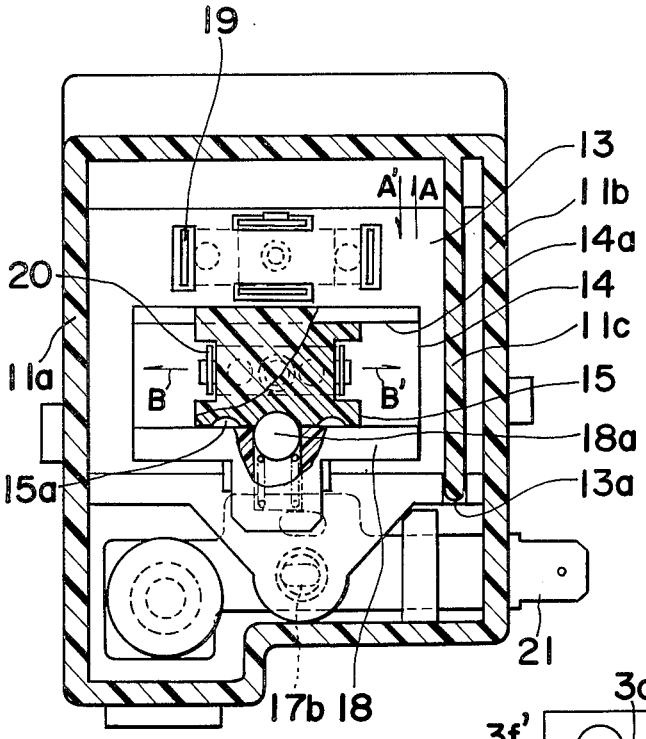
FIG. 3 is a sectional view of said multiposition switch along a line B—B of FIG. 2.

The first contact holder 13 is substantially rectangular in shape which is adapted to be fitted in and between the side walls 11*a* and 11*b* and is able to be moved between up and down positions thereof in a first direction of up and down as indicated by arrows A, A' in FIG. 3. The movement of said first contact holder 13 is guided by a guide wall 11*c* formed parallel and spaced a short distance relative to one side wall 11*b*. To this end, the surface of the first contact holder 13 is provided with a slot 13*a* being slidably engagable with said guide wall 11*b*. Moreover, a first click motion mechanism is provided between a click ball 17*a* supported spring-biasedly by the first contact holder 13 and each of click holes 17*b* provided on a support member 21 spaced apart from each other which is provided for mounting the multiposition switch to a member for supporting it. When the first contact holder 13 is moved upwardly or downwardly, the click motion corresponds to each up or down position thereof.

On the contrary to the above, the second contact holder 15 is supported by the first contact holder 13 slidably mounted thereto and in a second direction orthogonal to said first direction as indicated by arrows B, B' in FIG. 3. The second contact holder 15 is positioned in a rectangular aperture 14 of the first contact holder 13 which is elongated in the second direction and is guided slidably in said direction by a guide for 14*a* which is provided on a lengthwise wall of said rectangular aperture 14. The second contact holder 15 is designed to be movable in three positions aligned in the second direction. There is provided a second click-motion mechanism between a click ball 18*a* spring-biasedly supported in a support member 18 and each of three holes 15*a* provided on another side wall of the second holder 15 to provide a click motion corresponding to said each position thereof.

Figure 1:
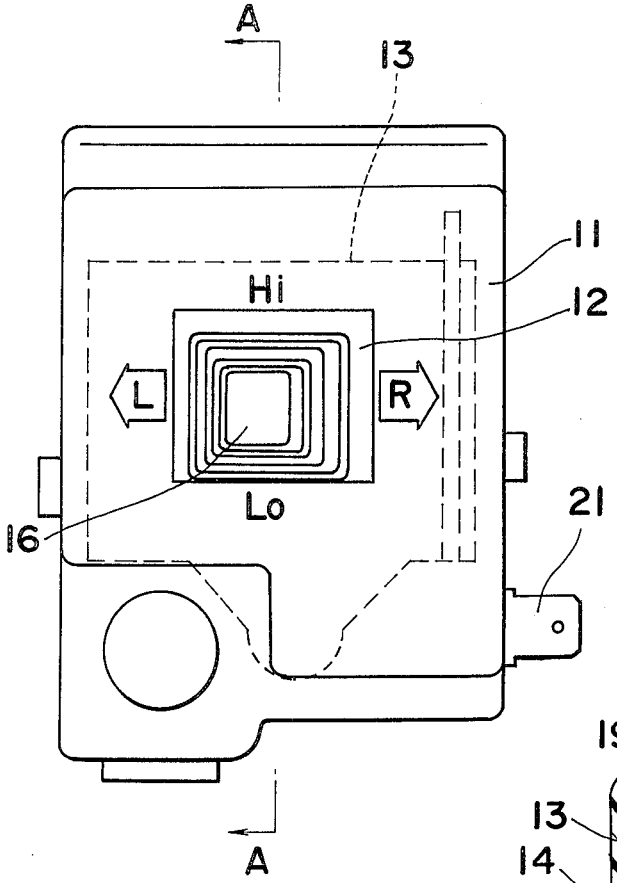
FIG. 1 is a front view of a multiposition switch according to a preferred embodiment of the present invention.

As shown in FIG. 1 and FIG. 2, an operation knob 16 is mounted to the top portion of the second contact holder 15 which projects operably and outwardly through an aperture 12 of the switch case 11. The aperture 12 is designed to permit six positions of the operation knob 16. Further, said aperture 12 is shielded from the outside of the multiposition switch by a slide plate 22 having a wider extension than that of said aperture 12 to cover it at any position of the operation knob 16.

As the result of the construction of the multiposition switch mentioned above, the operation knob 16 is operable between the six positions of the multiposition switch for choosing a desired position. FIG. 1 shows the positions of the multiposition switch by way of example.

The first switching contact 19 is adapted to connect the stationary contacts 3*a* and 3*b* when the operation knob 16 is positioned in the up-position Hi and to connect stationary contacts 3*a* and 3*c* when the operation knob 16 is operated to the down-position Lo.

On the contrary to the above, the second switching contact 20 is adapted to connect stationary contacts 3*d* and 3*f* when the operation knob 16 is operated from its neutral position to the left position L and to connect stationary contacts 3*d* and 3*e* when the operation knob 16 is operated from its neutral position to the right position R.

The first and second contacts 19, 20 and the first and second groups of stationary contacts 3*a*–3*e* and 3*d*–3*f* are designated to satisfy the connection relation mentioned above.

FIG. 4 shows an example where the multiposition switch according to the preferred embodiment of the present invention is utilized for a combination switch for a dimmer and direction indicator of a motorbicycle or motorcycle.

In this example, terminal 3*a'* is connected to a battery 24 via a light switch 23, terminal 3*b'* is connected to a main front light Hi, terminal 3*c'* is connected to a sub-front light Lo, terminal 3*d'* is connected directly to the battery 24, terminal 3*e'* is connected to a direction indicator R for indicating a turning to the right-hand side, and terminal 3*f'* is connected to a direction indicator L for indicating a turning to the left-hand side.

Figure 8:
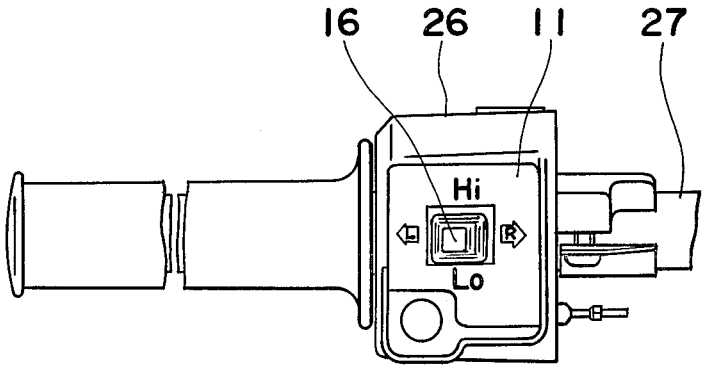
FIG. 8 is a front view of a portion of a handle of a motorbicycle being mounted with said multiposition switch.

The multiposition switch is fixed to a case 2*b* for mounting it to a handlebar 27 and the case is inserted on the handlebar 27 and is fixed to it in such a manner that a driver can easily operate the operation knob 16 of the multiposition switch as shown in FIG. 8.

Referring to FIG. 4, a state of normal driving during daytime is shown wherein the light switch 23 is turned off and the second switching contact 20 which constitutes the switch for switching the direction indicator is positioned in its neutral position.

When the driver operates the operation knob 16 from the neutral position to the left-hand side position L to indicate a turning to the left-hand side, the second switching contact 20 is moved to the left-hand side to connect stationary contacts 3*d* and 3*f*. As the result, the left-hand side direction indicator L is actuated to flash. Also, when the stationary contacts 3*d* and 3*e* are connected by the second switching contact 20, the right-hand side direction indicator R is actuated to flash.

During the night time, the light switch 23 is turned on, and, as the result, the main front light Hi is turned on. If the driver wants to switch from the main front light Hi to the sub-front light Lo, the driver operates the operation knob 16 from the upper position Hi to the lower position Lo to turn on the sub-front light Lo. As is known to those skilled in the art, both main and sub-front light Hi and Lo are adapted to be turned on overlappingly during the switching from Hi to Lo or vice versa.

Moreover, since the stationary contacts 3*d*, 3*e* and 3*f* are formed elongated in the first direction, or up and down direction, the connection relation therebetween is maintained unchanged during the switching operation of the operation knob 16 in the first direction. In other words, the driver can operate the operation knob 16 during a flashing of the left-hand or the right-hand side direction indicator L or R.

On the contrary to the above, a connection relation due to the first switching contact 19 is kept unchanged during the operation of the operation knob 16 for flashing the left-hand or the right-hand side direction indicator, since only the second switching contact 20 is moved in the second direction relative to the first switching contact 19 during said operation.

Although this invention has been described in its preferred form, it is understood that the present disclosure of the preferred form has been made only by way of example and that numerous change in the details of construction and combination and arrangement of parts may be resorted to without departing from the spirit and the scope of the invention as hereinafter claimed.

What is claimed is:

1. A multiposition switch comprising:

a switch case having an aperture;

an operation knob projecting operably through said aperture;

an insulator member being mounted to said switch case to define a space between said switch case and said insulator member;

first and second groups of stationary contacts being fixed on said insulator member in a predetermined arrangement;

first and second switching contacts for switching first and second groups of stationary contacts respectively;

first and second contact holders for holding first and second switching contacts being slidably inserted within said space;

said first contact holder being adapted to be moved in a first direction when the operation knob is operated in said first direction;

an aperture formed in said first contact holder;

said second contact holder being adapted to be moved in said aperture formed in said first contact holder in a second direction orthogonal to said first direction when the operation knob is operated in said second direction while said first contact holder is maintained at a neutral position thereof;

said operation knob being integrally formed with said second contact holder;

first click means including a first ball operatively arranged in the first contact holder and click holes provided on the insulator member for releasably retaining said first contact holder to said insulator member; and second click means including a second ball operatively arranged in the first contact holder and click holes provided on a side wall of the second contact holder for releasably retaining said first contact holder to said second contact holder;

said first and second groups of stationary contacts being initially constructed as a stencil-like member having been punched from a sheet of electrically conductive material and including a plurality of connecting portions for supporting said first and second groups of stationary contacts and a plurality of positions for fixing said stationary contacts to the insulator member being adapted to be insert-molded into said insulator member;

said stencil-like member being insert-molded together with said insulator member when it is molded, and said connecting portions being removed after the insert-molding of said stencil-like member to obtain said first and second stationary contacts.

2. A multiposition switch according to claim 1, said portions for fixing said stationary contacts to the insulator member being small projections projecting from said electrical contacts.

3. A multiposition switch according to claim 1, said portions for fixing said stationary contacts to the insulator member are concave portions stamped out at edge portions of said stationary contacts downwardly.

4. A multiposition switch according to any one of claims 1 or 2, said insulator member further includes a bar member for fixing stationary contacts thereonto together with said connecting portions.

* * * * *